United States Patent [19]

Hara et al.

[11] 3,985,182

[45] Oct. 12, 1976

[54] HEAT TRANSFER DEVICE

[75] Inventors: Toshitsugu Hara; Motokazu Uchida, both of Tokyo; Michio Yanadori, Hachioji; Yasushige Kashiwabara, Musashino, all of Japan

[73] Assignee: Hitachi, Ltd., Japan

[22] Filed: Aug. 14, 1974

[21] Appl. No.: 497,397

[30] Foreign Application Priority Data

Mar. 17, 1973 Japan ..... 48-91738

[52] U.S. Cl. ..... 165/32; 165/105; 62/333; 62/259

[51] Int. Cl.[2] ..... F28D 15/00

[58] Field of Search ..... 165/32, 105

[56] References Cited

UNITED STATES PATENTS

| | | | |
|---|---|---|---|
| 1,725,906 | 8/1929 | Gay | 165/105 |
| 2,581,347 | 1/1952 | Backstrom | 165/105 X |
| 3,525,386 | 8/1970 | Grover | 165/32 |
| 3,613,773 | 10/1971 | Hall et al. | 165/105 X |
| 3,672,443 | 6/1972 | Bienert et al. | 165/105 X |
| 3,763,838 | 10/1973 | Lindsay et al. | 165/32 X |
| 3,782,449 | 1/1974 | Busse et al. | 165/32 |
| 3,807,493 | 4/1974 | Stewart | 165/105 |

*Primary Examiner*—Albert W. Davis, Jr.
*Attorney, Agent, or Firm*—Craig & Antonelli

[57] ABSTRACT

A heat transfer device comprising a liquid having a low boiling point and a non-condensable gas, said liquid and said gas being charged in a vessel, said vessel being separated into a heating section and a cooling section by means of an adiabatic member to cause said liquid to boil at temperatures above a desired temperature.

In the heat transfer device, a great amount of heat is transferred at temperatures above a desired temperature by causing vapor bubbles to transfer from said heating section to said cooling section, said bubbles resulting from boiling of said liquid, while no heat transfer is effected between the aforesaid two sections at temperatures below the desired temperatures.

The heat transfer device is suited for use in such apparatuses or machines which require a thermal valving function, especially for use in a refrigerator.

5 Claims, 17 Drawing Figures

HEAT TRANSFER DEVICE

This invention relates to a heat transfer device achieving a specific function which has not been attained by the prior art.

Hitherto, in a case of effecting heat transfer from one place to another, it has been a common practice to place a material having good thermal conductivity such as that of a metal between said two places to thereby effect the heat transfer by using the thermal conduction of said material, or to use the convection, boiling, or condensation of a liquid for effecting said heat transfer.

In conventional devices, if there is a temperature difference between two places, heat will necessarily be transferred from the higher temperature place to the lower. In this respect, the amount of heat transferred is substantially in proportion to the temperature difference. According to the prior art methods, the amount of heat to be transferred is only dependent on the temperature difference which is present between two places, rather than on an absolute value of temperature.

More particularly, the prior art methods permit the transfer of a great amount of heat from one place to another in spite of a small temperature difference by using the boiling and condensation of a liquid. However, according to such methods, there may not be achieved such a thermal switching function, as for instance, heat is not substantially transferred when a detected temperature is below a predetermined value even if there is a considerable temperature difference between two places, while heat may be transferred at a temperature above said predetermined temperature.

To achieve the aforesaid function, the prior art methods must use a thermal detector to stop the flow of vapor or fluid by closing a valve according to a signal issued from the aforesaid thermal detector, thereby rendering the construction complicated and resulting in lowered reliability. To overcome the above shortcomings, an attempt has recently been proposed, wherein a small amount of non-condensable gas is charged in a vessel beforehand, while the pressure within the vessel is controlled for establishing the boiling point of a liquid. However, the non-condensable gas tends to be accumulated in the vicinity of a condensation surface as the time goes on, and hence the vapor of the liquid should reach the condensing surfaces through this non-condensable gas layer, so that the condensing heat transfer rate will be lowered rapidly in spite of the charge of a very small amount of non-condensable gas. For this reason, it is not preferable that non-condensing vapor of an amount over 0.1 kg/cm$^2$ is charged therein, because of deterioration in the performance of thermal transfer, which leads to the failure to transfer a great amount of heat. On the other hand, although non-condensable gas of a small amount will not result in the considerable decrease in the condensing heat transmission rate, the set pressure is too low to set the boiling point accurately. For instance, in case freon R-114 is used as a refrigerant, the saturation pressure thereof will increase in an exponential-function-manner with regard to temperature, so that the pressure required for setting the saturation temperature at an error within $\pm 1°$ C should be as low as $\pm 0.01$ kg/cm$^2$ at a pressure of 0.1 atm., thus failing to meet the requirement for the practical application.

It is the primary object of the present invention to provide a heat transferring device which avoids the aforesaid shortcomings experienced with the prior art devices and which affords a thermal valving function and permits the transfer of a great amount of heat with ease.

It is the second object of the present invention to provide a heat transfer device which has a thermally valving function and permits the accurate setting of the operational temperature to an arbitrary value as well as the transfer of a great amount of heat with ease.

The third object of the present invention is to provide a refrigerator etc., in which two chambers or more provided therein are completely separated from each other with respect to the point of air flow and the temperature in each chamber can be freely set without said air flow by use of the above-mentioned heat transferring device.

The heat transferring device of the present invention comprises a vessel extending through an adiabatic wall or member adapted to separate a high-temperature compartment from a low-temperature compartment, one part of which vessel is located within the space of said high-temperature compartment, another part of which vessel is located in the space of said low-temperature compartment. Filled in the vessel are a liquid having a low boiling point which boils at a temperature above a predetermined temperature and a gas which is non-condensable at a temperature within a predetermined temperature range. Bubbles produced due to the boiling of the liquid having a low boiling point, which liquid in the high-temperature compartment is of a temperature above said predetermined temperature, are moved from said high-temperature compartment to the low-temperature compartment so that the heat transferring device is made to have such a thermally valving function as a great amount of heat is transferred from the high-temperature compartment to the low-temperature compartment.

Now, the principle of the present invention will be described in conjunction with one embodiment of the present invention.

Figure 1:
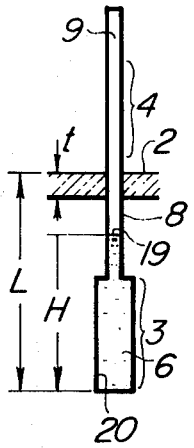
FIG. 1 is a cross sectional schematic drawing illustrating the principal construction of the present invention.

Referring to FIG. 1, shown at 8 is a vessel which contains a liquid and a non-condensable gas and defines the passage of heat, at 6 a liquid having a low boiling point, at 9 a non-condensable gas. Shown at 3 is a heat section, at 4 a cooling section, at 2 heat insulating wall which thermally divides the vessel into the heating portion 3 and the cooling section 4. The liquid having a low boiling point and the non-condensable gas 9 are charged in the vessel 8 at a suitable pressure dependent on the operational temperature and the saturating vapor pressure of the liquid 6. The above-mentioned constitution gives no difference between the device according to the present invention and those of the prior art. The features of the device according to the present invention lie in the following points. Namely, as shown in FIG. 1, a part of the vessel is made small in diameter to reduce the area of the liquid surface 19 which contacts the non-condensable gas, thereby reducing the amount of vapor during the non-boiling period (said surface 19 being so called a free surface of the liquid) and at the same time there is readily achieved such an action of the bubbles as lifting the liquid upwards which action will be described hereinafter. In addition, the surface 20 (so called heat transfer surface) of the vessel 8 contacting the liquid 6 is so designed as to be enlarged to a maximum extent to thereby increase the amount of heat transferred at the time of boiling. Further, the amount of the liquid 6 charged is determined such that the liquid surface 19 does not reach up to the cooling section 4 but is positioned at a point lower than that of said section 4 at the non-boiling time while the liquid surface 19 reaches the cooling section at the boiling time.

Even if the temperature of liquid 6 is raised by a heat source, liquid 6 will not boil until the saturated vapor pressure becomes higher than the charging pressure of the gas, and said liquid will not be vaporized from the surface since the surface thereof is covered with the non-condensable gas 9 and since the vapor pressure is smaller as compared with the charging pressure. On the other hand, since the rate of the evaporation of liquid 6 is little, because of the small area of the free surface 19 and since the layer of non-condensable gas 9 having a high concentration covers the surface of the liquid, the vapor will not substantially reach the condensing surface 4. As a result, even if the liquid 6 is heated, the heat will not be carried away with vapor, so that heat will be only transferred through the wall of the vessel due to heat conductivity. In such case, the wall of the vessel should be made of a material having a small thermal conductivity and a small thickness, thereby limiting the amount of heat to be transferred to a small degree.

Figure 2:
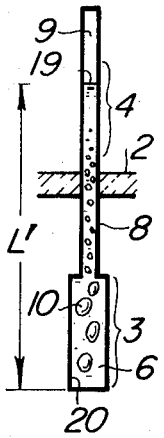
FIG. 2 is a schematic cross section illustrating the principle of the present invention.

In contrast thereto, if the temperature of liquid 6 exceeds a certain value and then the saturating pressure is higher than the charging pressure, the liquid 6 will commence boiling as shown in FIG. 2, while many vapor bubbles are produced in the liquid. The bubbles 10 rise up to the surface due to their buoyance while increasing the apparent volume of liquid 6. For this reason, the free surface of liquid 6 is lifted up and eventually reaches the cooling section 4. At this time, since the liquid 6 in the vicinity of the cooling section 4 is cooled to below the saturating temperature, the bubbles floating are condensed within the liquid existing in the neighborhood of the cooling section. In other words, the vapor is readily condensed and transfers the heat without undergoing the influence of the thermal resistance of the non-condensable vapor. This is one of the prominent feature of the present invention. Furthermore, this phenomenon occurs only at the boiling time and can not occur at the time of non-boiling.

In other words, the thermal resistance from the heating surface to the cooling surface may be abruptly changed at the boundary of a critical temperature. The smaller the diameter of the vessel 8 becomes, the less the slippage occurs between the bubbles and the liquid, and the more effectively the rising action of the liquid surface occurs. On the other hand, the wider the surface of the heat transfer surface 20 becomes, the more vigorous the generation of bubbles occurs, thereby enhancing the surface rising action, with the accompanying increase in the amount of heat transferred.

By utilizing the liquid-face rising action due to the bubbles (so-called bubble pumping function) and the boiling phenomenon in the liquid, heat is not transferred at temperatures below the boiling point, while after the boiling of the liquid, a great amount of heat is transferred rapidly. When the bubbles produced due to boiling are made to rise and are then condensed in the liquid in the neighborhood of the cooling section, the heat of vapor is transferred through the medium of the liquid to the cooling surface. In this respect, it was found that the thermal transfer rate is substantially great. For instance, when fluoro-carbon (hydrocarbon fluoride) is condensed, the heat transfer rate due to the condensation is about 400 Kcal/cm$^2$.h.° C in a case where air of 10% by weight is mixed in the vapor, whereas said heat transfer rate became about 1500 Kcal/cm$^2$.h.° C in a case where the vapor is condensed in the liquid. It has been well known that the bubbles are condensed to become liquid after the heat thereof is removed and then descend under the action of the gravity.

Figure 3:
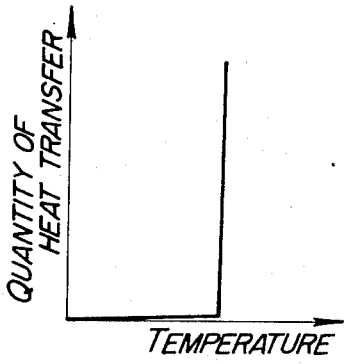
FIG. 3 is a diagram showing the operational characteristics of the device according to the present invention.

FIG. 3 shows a curve illustrating the relationship between the temperature and the amount of heat transferred, with the temperature presented as an abscissa and the amount of heat transferred as an ordinate, which curve is based on the experiment using a vessel of inner diameter of 1 cm and length of 30 cm, fluorocarbon as liquid 6 and air as non-condensable gas 9. Apparently, this proves the prominent effect of the thermally valving action of the device embodying the present invention, as contrasted to the performances of the prior art devices.

Description has not been referred to the types of materials used for vessel 8. This is because any materials afford no influence on the present invention. For instance, in a case of a vessel made of a steel, the vessel is satisfactory if the thickness of the vessel may be sufficiently reduced. Alternatively, the vessel may be made of ceramics, glass or plastic and the like. In short, any vessel may be used, as far as the vessel may withstand the charging pressure and the temperatures in the operational temperature range. However, there are preferred configurations of the vessel from the viewpoint of heat transfer effect, and thus the configurations of the vessel will be described hereinunder.

In general, for the balance of forces in the liquid, assume that the depth of the initial liquid is H, the depth of the liquid when bubbles are produced is L′ and the volume of bubbles occupying (so called void factor) is $\alpha$, then $$L' = \frac{H}{1-\alpha}, \quad \text{wherein } 0 \leq \alpha < 1 \qquad (1)$$

On the other hand, the void factor $\alpha$ is given as follows, assuming that the volume of bubbles produced for unit time is $Q_g$ ($m^3/h$), the floating velocity of bubbles is $U_g$ ($m/h$), and the surface area of liquid contacting non-condensable gas is $A_o$ ($m^2$) (in an example that the vessel is vertically placed to the horizontal plane as shown in FIGS. 1 and 2, this value corresponds to cross sectional area of vessel);

$$\alpha = \frac{Q_g}{U_g A_o} \quad (2)$$

Further assume that the latent heat of the liquid is $r$ (Kcal/Kg), the specific gravity of the vapor of the liquid is $\gamma_g$ (Kg/m$^3$), the amount of heat transfer is Q (Kcal/h), the boiling heat transfer rate is h (Kcal/m$^2$.h.° C), temperature difference is $\Delta T$ (° C), the area of the heating section contacting the liquid (heat transfer area) is A ($m^2$), then $$Q_g = \frac{Q}{r\gamma_g} \quad (3)$$

$$Q = h\,\Delta T \,.\, A \quad (4)$$

When the equations (2), (3) and (4) are substituted by the equation (1), then the equation representing the surface rising of liquid will be given as follows:

$$L' = \frac{H}{1 - \frac{h\Delta T}{r\gamma_g U_g} \cdot \frac{A}{A_o}} \quad (5)$$

Since $r$, $\gamma_g$, $U_g$ are substantially constant, assume that $h$ and $\Delta T$ are constant, then L' is greater as $A/A_o$ will increase, eventually exceeding the value of L which is the height up to the insulating wall. In other words, the smaller the heat transfer area A becomes, the greater L' becomes, thereby increasing the amount of heat transferred and enhancing the heat transfer effect. In this respect, such a relation as $L \leqq L'$ is necessary for effecting the heat transfer at the time of boiling, while such a relation as $H < L$ is necessary not to effect the heat transfer at non-boiling time. Thus, the following equation will be derived from the equation (5) and the aforesaid conditions;

$$1 - C \cdot \frac{1}{\gamma_g r} \cdot \frac{A}{A_o} \leqq \frac{H}{L} < L \quad (6)$$

wherein $C = h \,.\, \Delta T/U_g$, and L represents the distance from the vessel bottom to the top of the insulating wall. It is required for minimizing thermal leak that the height of liquid level H be smaller than L, as can be seen in FIG. 1.

Further, it is desirable to determine the value of L and H such that the following relation exists in a case where the thickness of the thermally adiabatic wall 2 is $t$:

$$H/L \quad 1 - t/L \quad (7)$$

The present invention will now be described in more detail with reference to one embodiment of the present invention.

Figure 4:
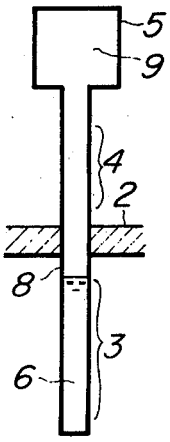
FIGS. 4 to 8 are cross sections showing other embodiments of the present invention, respectively.

FIG. 4 shows one embodiment of the present invention, in which the vessel 8 is made of a tube having a small diameter throughout the length thereof, with a non-condensable tank 5 (so-called reservoir) located on top thereof. The provision of a tank 5 having a large capacity permits the maintenance of the same pressure as that of the charging time, even if the surface of the liquid rises. This presents a sharply uprising curve as shown in FIG. 3. This has also been well proved by the experiments.

Figure 5:
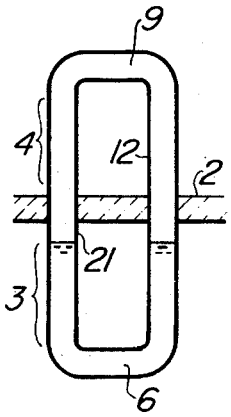

FIG. 5 shows another embodiment of the present invention, in which there is provided a descending flow tube 12 in addition to the flow ascending tube 21, whereby the vapor ascending and liquid may be separated into two-phase flow and a liquid flow, so that there is no possibility of interference with each other, rendering returning of the liquid flow easy. As a result, a bubble pumping action is effected efficiently, presenting the amount of heat transfer two times as much as that of the case with a single tube, as proved by experiments. In addition, by the results of the experiment, it becomes clear that the particularly satisfactory circulation of liquid and the increased amount of heat transfer are obtained in case the cross sectional area of the flow-ascending tube is of not more than 36 mm$^2$.

Figure 6:
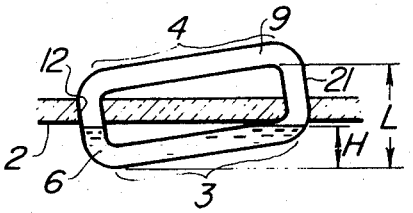

FIG. 6 shows a still further embodiment of the present invention, in which the heating section 3 and the cooling section 4 are positioned in the upper and lower portions, respectively. However, it is preferable that every portion of the vessel be inclined to some degree with respect to the horizontal.

In this case, the value of L is the height of the liquid just before said liquid ascending upwardly in the tube 21 because of the bubbles occurring in said liquid further flows downwardly toward the tube 12 from the top of the tube 21 through the cooling section 4. In this respect, improvements in the heat transfer characteristics may be expected by suitably selecting the angles of heating section 3 and cooling section 4 to the horizontal, which sections 3 and 4 are positioned in upper and lower portions, respectively, or by suitably varing the circulating impedance of heat medium which circulates through the vessel (for instance, the diameter of the tube in the heating section 3 is increased, while the diameter of the tube 21 is reduced than that of the diameter of the tube in the heating section 3 and yet the length of the tube is made less than that of the tube 12, and these matters are combined, thereby improving the heat transfer characteristics).

Figure 7:
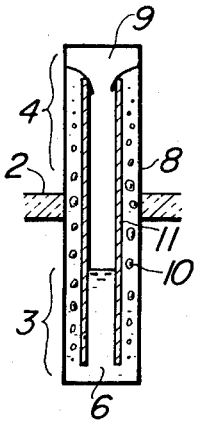

FIG. 7 shows a still further embodiment of the present invention, in which a flow-ascending tube and flow-descending tube are received in the same container, and show a state that the temperature at the liquid 6 is higher than the saturation temperature to thereby produce bubbles 10.

Any types of liquids may be used as a liquid 6, as far as it is of a low boiling point. As the liquid 6 there are used, in addition to fluoro-carbon which has been described above, alcohol, water, mercury, alkali metals such as potassium and the like, silicon oil, liquid nitrogen, liquid oxygen and liquid natural gas, etc. On the other hand, as the non-condensable gas 9 are preferably used those which should be chemically stable against the liquid 6. Thus, in addition to the aforesaid air, there are used nitrogen, argon gas, carbon-dioxide gas and the like.

Figure 8:
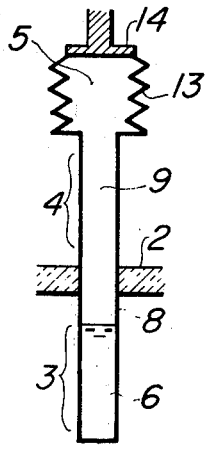
Figure 9:
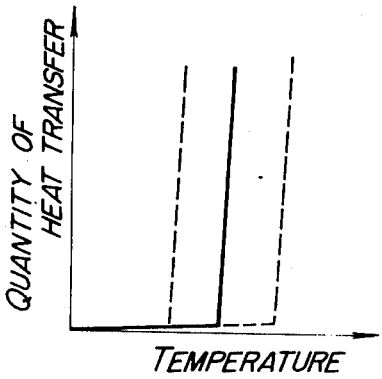
FIG. 9 is a diagram showing the operational characteristics of the device according to the present invention.

FIG. 8 shows a yet further embodiment of the present invention, in which part 13 of the vessel 8 is made of a flexible material (such as metallic bellows) that is used to vary the charging pressure of the non-condensable gas by varying the inner volume of the vessel 8 due to a pressing member 14 by applying a pressure thereon or by extending same. FIG. 9 shows the relationship between the temperature and the amount of heat transferred, in which the uprising curve of temperature may be varied.

Meanwhile, in case the charging pressure of noncondensable gas is low, the saturating temperature may not be accurately set. However, it is found by the result of experiments that the use of fluoro-carbon and air has resulted in the achievement of accuracy of ± 1° C at a pressure of 0.3 kg/cm².

As is apparent from the foregoing description, the present invention dispenses with a temperature detecting device of a complicated construction but presents a heat transfer device of a simple construction having no valve, yet presenting a valving action by being operated according to the temperature which has been properly set by examination for the flow of heat. Although description has been referred to the heat transfer device, the description hereinafter will be given in the aspect of the aforesaid heat transfer device.

For instance, the present invention may provide a refrigerator which may cool at least two chambers having different temperatures, by using a single cooling device, without resorting to air communication or air flow.

According to the prior art refrigerator, the air which has been cooled in a freezing compartment is introduced through an air passage into a freezing compartment, while part of the return air from the freezing compartment to the cooling device is injected into the freezing compartment to cool the latter. In most cases, the temperature in the freezing compartment is maintained at −20° C, while the temperature in the refrigerator should be maintained at 2° to 5° C, so that it is a practice that the temperature in the refrigerator is detected, and then the amount of cool air to be fed to the refrigerator is adjusted by the temperature thus detected.

The refrigerator according to the prior art is provided in this manner. However, since the cooling device compartment is in communication with the freezing compartment, the freezing compartment being also in communication with the refrigerator, and the refrigerator with the cooling device compartment through a hole of a small diameter, air having a high temperature such as that in the refrigerator may possibly make ingress into the cooling device compartment having a low temperature, whereby the air having high temperature and humidity will contact the surface of the cooling device, producing frosts thereon. The moisture in foods stored in the refrigerator is taken in the cooling device, whose temperature is the lowest, and then frosted therein, so that the foods stored are dried. When the frosts are produced on the surface of the cooling device, then the cooling capability will be lowered due to the poor thermal conductivity of frosts, so that defrosting should be carried out once in a while by using a heater or causing a high temperature coolant to flow in the neighborhood of frosts.

In the aforesaid instance, its construction is such that the moisture is all taken in the cooling device, or the door of the refrigerator is opened frequently to introduce outside air which contains moisture. This dictates the frequent use of defrosting, with the accompanying consumption of electric power. In addition, the freezing compartment is also to be heated, and thus another consumption of electric power for restoring the temperature back to −20° C will be considerable. Still furthermore, considerable man power should be used for actions to protect from drying foods or the like stored in the refrigerator, thus preventing inconvenience.

For avoiding such a shortcoming, an attempt has been proposed, in which the freezing compartment is completely separated from the refrigerating compartment, with one or all sides of the refreezing compartment covered with a material having high heat conductivity, while the air in the refrigerating compartment is agitated by a fan provided in the refrigerating compartment, whereby the temperature in the refrigerating compartment is controlled according to the degree of agitation. According to such an attempt, foods may be protected from drying and the amount of frost is less. However, the rotation frequency of a fan motor should be controlled so as to vary the thermal transfer rate of the heat transfer wall, and there should be provided a temperature detector for detecting the temperature in the refrigerating compartment, resulting in complicated and costly construction and lowered reliability.

According to the present invention, those shortcomings may be avoided, with accompanying minimized-consumption of electric power and convenience in application.

Figure 10:
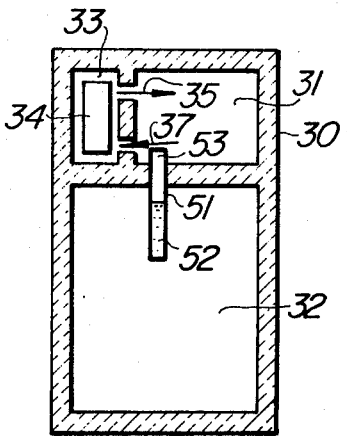
FIGS. 10 to 17 are cross-sectional diagrams illustrating the applications of the device according to the present invention.

FIG. 10 is a view illustrating the principle of the refrigerator embodying the present invention. The aforesaid heat transfer device 51 extends through a partition wall bounded by the freezing compartment 31 and a refrigerating compartment 32, while the lower portion of the device 51 is located within the refrigerating compartment 32 and the upper portion thereof is positioned within the freezing compartment 31. There is no limitation on the size and setup position of heat transfer device 51. FIG. 10 shows the cases where the device extends longer in the refrigerating compartment 32 and shorter in the freezing compartment 31. As a result, there is no communication of air between the refrigerating compartment 32 and the freezing compartment 31.

With such an arrangement, the freezing compartment 31 is cooled with cold air 35 from the cooling device compartment 33, while the refrigerating compartment 42 is cooled by means of a heat transfer device 51. Now, assume that the temperature in the refrigerating compartment is higher than the specified value. This specified value is dependent on the functions required for the refrigerating compartment 32, and ranges from 2° to 5° C in most cases. However, this should not be limited. As has been described earlier, when the temperature exceeds this specified value, then the liquid 52 charged in the heat transfer device 51 commences boiling, and thus the vapor bubbles lift the surface of liquid 52 within the device 51, so that the surface of the liquid reaches the upper space 53 of the heat transfer device 52. Accordingly, the vapor bubbles may readily reach the upper space through the liquid, without undergoing the influence of the non-condensable gas charged within the space 53. In this manner, the refrigerating compartment 32 is cooled. When the temperature in the refrigerating compartment is below the specified value, then the upper portion of the heat transfer device will be thermally separated from the lower portion thereof in a manner that the freezing compartment 31 is substantially completely thermally isolated from the refrigerating compartment 32, and thus the refrigerating compartment is cooled to below the specified value.

With the refrigerator according to the present invention, since the there is no communication of air between the freezing compartment and the refrigerating compartment and the heat transfer device itself is provided with functions as a temperature detector and control device for controlling thermal flows, there is required no specific temperature detector nor the specific control circuit. This minimizes the adhesion of frosts and may provide an inexpensive refrigerator having good controllability.

The aforesaid embodiment refers to the case where the freezing compartment 31 and the refrigerating compartment 32 are cooled independently through the medium of heat transfer device 51. However, the performance of the heat transfer device may be further improved by providing the heat transfer device which satisfies the following requirements. Suppose that the respective temperatures required for the freezing compartment 31 and the refrigerating compartment 32 are, for instance, −18° C and +2° C at the atmospheric temperature of 30° C, if the atmospheric temperature is varied, for instance, to 10° C, it would not be suited as a refrigerator that the temperature in refrigerating compartment 32 varies largely from the temperature of +2° C. According to experiments given by the inventors, the fluoro-carbon is used as a liquid having a low boiling point, so that the temperature in the refrigerating compartment could be maintained substantially at 2° ± 1° C when the ratio of the amount of heat transferred during the boiling time to that at the non-boiling time (the ratio of amount of heat transferred) was made approximately over 17. This corresponds to a case where the ratio ($A/A_o$) of the heat transfer area A in the heating section to the cross sectional area $A_o$ of the vessel is more than 30. In addition, when the ratio $A/A_o$ is below 10, the ratio of transferred heat will be below 5, thus losing the thermally valving function.

Although description has been given with reference to FIG. 10 of the case where the upper portion of the heat transfer device 51 is positioned in the freezing compartment 31, this is merely intended to facilitate the assembling operation of the present device, and thus the construction shown should not necessarily be followed, but the device 51 may be brought into direct contact with the cooling device 34. Alternatively, the device may be positioned anywhere within the freezing compartment 31. In addition, FIG. 10 shows the heat transfer device 51 of a single tube form, but this also should not necessarily be followed, but may be of a flat plate form or a plurality of tubes arranged in parallel.

Figure 11:
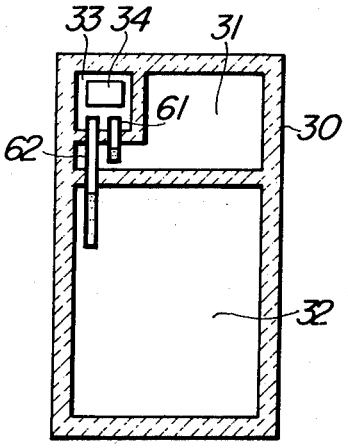

FIG. 11 shows a still further embodiment, wherein a heat transfer device 61 for the freezing compartment and a heat transfer device 62 for the refrigerating compartment are separately provided within the cooling device compartment 33 which houses the cooling device 34 therein. With this arrangement, since the cooling device compartment 22 is closed in the sense of communication of air, the atmosphere does not make ingress therein nor there is a possibility of frosts of being produced on the surface of the cooling device 34. This precludes the decrease in heat transfer rate in the cooling device, thereby enhancing the performance of the device. Alternatively, a compressor may be rendered compact in size for continuous operation rather than intermittent operation. This dispenses with such a detector, controls and switches required for ON-OFF control of a compressor, which have been employed in the conventional device, thereby presenting a refrigerator less costly and high in reliability. It is needless to mention that any configuration and position may be used for the heat transfer device and that the compartments may be over three in number instead of two compartments.

Figure 12:
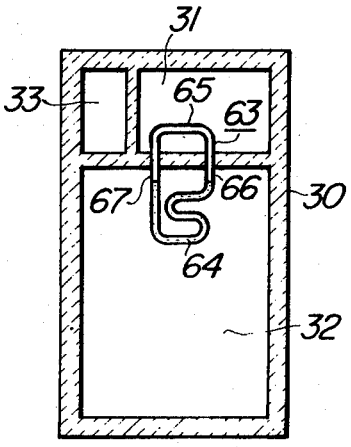

FIG. 12 shows a cross-sectional view of a refrigerator as viewed sidewise. In this case, the heat transfer device 63 is of an annular form and has its upper portion charged with non-condensable gas 65. When the liquid 64 in the lower portion boils, then the liquid is lifted due to the bubbles i.e., a pumping action of said bubbles, through the flow ascending tube 66, after which the bubbles are cooled in the upper portion 65 for condensation. Then, the liquid thus condensated returns to its initial position through the flow-descending tube 67. Such separation of the passages for ascending and descending flows eliminates the interruption with each other and minimize flow resistance.

Figure 13:
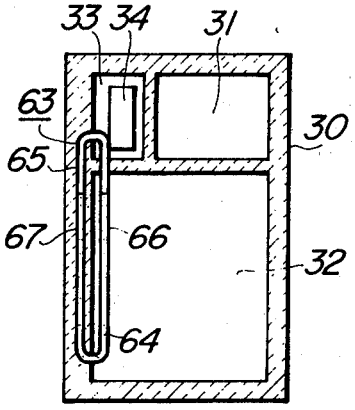

FIG. 13 shows a further embodiment of the present invention, in which the cooling device compartment 33 is coupled through the medium of heat transfer device 63 to the refrigerating compartment 32. As shown, when the upper portion 65 of the device 63 is brought into direct contact with the cooling device 34, then the heat resistance is lessened, enhancing the advantage of the present invention. As shown, if the flow-descending tube 67 which is part of the device 63 is thermally insulated, as shown, the circulating action due to the bubble pumping action becomes vigorous, enhancing the advantage of the present invention.

Figure 14:
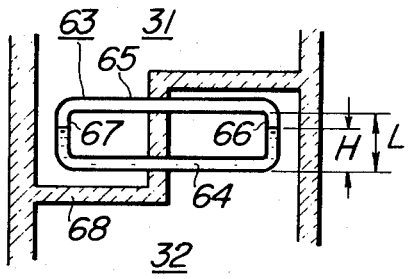

FIG. 14 shows a yet further embodiment of the present invention and is a cross-sectional view of a partition wall between the freezing compartment 31 and the refrigerating compartment 32, when the front of the refrigerator is viewed. In this case as well, there are provided annular heat transfer devices 63, and the cooling side and heating side are positioned on the horizontally opposite positions, rather than the vertical direction, thereby providing smooth flow of liquid therein. Shown at 68 is a partition wall between the freezing compartment 31 and the refrigerating compartment 32. Character L′ in this case represents the height of the liquid surface just before the liquid flows upwardly due to the movement of bubbles.

Figure 15:
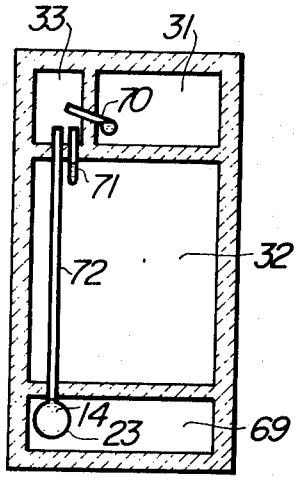

FIG. 15 shows a further embodiment of the present invention, in which there are shown three compartments, in contrast to the two compartments of two temperature type, which have been described thus far. In this case, there may be used heat transfer devices 70, 71 and 72 having different operating temperatures to maintain the three compartments at different temperatures. Otherwise, two compartments on the refrigerating compartments (32 and 69) may be maintained at the same temperature but at different humidities, so that vegetables, fruit and the like are stored in the second refrigerating compartment 69. In this case, the diameter of a part (flow-ascending tube) of the heat transfer device 72 is reduced to facilitate the rising of the liquid surface, while preventing the temperature influence due to refrigerating compartment by insulating the heat. As can be seen, three compartments may be used in the present invention, instead of the provision of two chambers. In this case as well, it only needs to provide additional heat transfer devices, and temperature detectors and controls are likewise not necessary.

Figure 16:
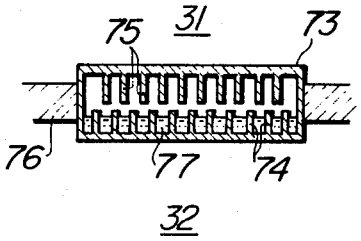

FIG. 16 shows a further embodiment of the present invention, in which, in contrast to the use of a tubular form of the heat transfer device, there is provided a heat transfer device 73 on a partition wall 76 of a box type between the refreezing compartment 31 and the refrigerating compartment 32. Provided on the inner surface of the box are projections 74 and 75 in the upper and lower surfaces thereof, respectively, to facilitate rising of liquid surface so as to cause the liquid to contact the upper projection 75, when the liquid 77 boils.

As has been described earlier, it is a fundamental practice to use a heat transfer device using a liquid and a non-condensable gas in the application of the refrigerator according to the present invention, although the configuration of the device may be varied. For instance, a fan may be provided in the heat transfer device, or a fan may be provided within the refrigerator, or the cooling section or heating section of the heat transfer device may be of a zig-zag construction. Those factors, however, depend on the requirements for the device, and such factors are not detrimental to the fundamental features of the present invention. In either case, since the freezing compartment is completely separated from the refrigerating compartment, no frosting will result, and in addition there is no possibility of foods being dried. Yet, the refrigerator according to the present invention affords a high performances without using a complicated and costly detectors and control circuits.

Figure 17:
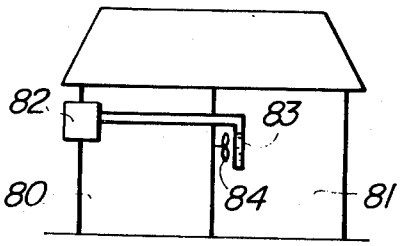

FIG. 17 shows another embodiment, in which the present invention is applied to a cooling device for a room. Shown at 80 and 81 are independent rooms, and the rooms 80 and 81 may be cooled independently by means of a cooler 82. The room 80 may be directly cooled by means of a single cooler 82, independently, while the room 81 is set for a suitable temperature by means of a heat transfer device 83 having the aforesaid functions and connected to the cooler 82. Shown at 84 is a fan for use in circulating air, and the fan 84 is adapted for effective heat exchange of the heat transfer device 83.

What is claimed is:

1. In a heat transfer device comprising a thermally insulated wall adapted to separate a high temperature section from a low temperature section, a vessel extending through said thermaly insulated wall, one portion of said vessel being placed in the high temperature section and another portion of said vessel being placed in a low temperature section, a liquid of low boiling temperature which boils at a temperature above a predetermined temperature being provided within said vessel, and a gas which is non-condensable within a predetermined range being provided within said vessel, whereby the heat transfer device has a valving function so that heat is transferred from the high temperature section to the low temperature section at a temperature above the predetermined temperature by the liquid surface-rising, bubble pumping action produced by the boiling of said liquid, the liquid surface of said liquid and the geometrical configuration of said vessel being designed in accordance with the equation $$1 - C \cdot \frac{1}{\gamma_g \cdot r} \cdot \frac{A}{A_0} \leq \frac{H}{L} < 1$$

where C is a constant, $\gamma g$ is the specific gravity of vapor of said liquid, r is the latent heat of said liquid, A is the area of a heating section contacting said liquid, $A_o$ is the surface area of said liquid in contact with said gas, H is the depth of said liquid in the initial state, and L is the distance from the inner bottom surface of said vessel to the top of said thermally insulated wall.

2. A heat transfer device as set forth in claim 1, wherein said vessel comprises a flow-ascending tube and a flow-descending tube operatively associated with each other.

3. A heat transfer device as set forth in claim 1, wherein said vessel includes a flexible means for varying the inner volume of said vessel to vary the charging pressure of said gas.

4. In a heat transfer device comprising a thermally insulated wall adapted to separate a high temperature section from a low temperature section, a vessel extending through said thermally insulated wall with one portion of said vessel being disposed in the high temperature section and another portion of said vessel being disposed in the low temperature section, a liquid of low boiling temperature which boils at a temperature above a predetermined temperature being provided within said vessel, and a gas which is non-condensable within a predetermined range being provided within said vessel, whereby the heat transfer device has a valving function so that heat is transferred from the high temperature section at a temperature above the predetermined temperature by the liquid surface - rising, bubble pumping action produced by the boiling of said liquid, the device being so designed that the relationship of said liquid and the geometrical configuration of said vessel is in accordance with the equation $$1 - C \cdot \frac{1}{\gamma_g \cdot r} \cdot \frac{A}{A_o} \leq \frac{H}{L} \leq 1 - \frac{t}{L}$$

wherein C is a constant, $\gamma_g$ is specific gravity of the vapor of said liquid, $r$ is latent heat of said liquid, A is the area of a heat section contacting said liquid, $A_o$ is the surface area of said liquid in contact with said gas, H is the depth of said liquid, L is the distance from the inner bottom surface of said vessel to the top of said thermally insulated wall, and t is the thickness of said thermally insulated wall.

5. A heat transfer device as set forth in claim 4, wherein the area A of the heat section contacting said liquid and the surface area $A_o$ of said liquid in contact with said gas have the following relationship $$A/A_o \geq 10.$$

* * * * *